United States Patent [19]

Fox et al.

[11] Patent Number: 4,621,219

[45] Date of Patent: Nov. 4, 1986

[54] ELECTRON BEAM SCRAMBLER

[75] Inventors: Lowell J. Fox, Redwood City; Joseph J. Manca, Sunnyvale, both of Calif.

[73] Assignee: Varian Associates, Inc., Palo Alto, Calif.

[21] Appl. No.: 630,221

[22] Filed: Jul. 17, 1984

[51] Int. Cl.[4] ..... H01J 25/02

[52] U.S. Cl. ..... 315/5; 315/3; 315/5.35; 315/5.38

[58] Field of Search ..... 315/3, 4, 5, 5.38, 5.35

[56] References Cited

U.S. PATENT DOCUMENTS

| | | | |
|---|---|---|---|
| 3,153,743 | 10/1964 | Meyerer | 315/5.38 |
| 3,297,907 | 1/1967 | Rue et al. | 315/5.38 X |
| 3,394,282 | 7/1968 | Schmidt | 315/5.38 X |
| 3,463,959 | 8/1969 | Jory et al. | 315/5 |
| 4,224,576 | 9/1980 | Granatstein et al. | 315/5 |
| 4,395,656 | 7/1983 | Kosmahl | 315/5 |
| 4,482,843 | 11/1984 | Perring | 315/4 |

*Primary Examiner*—Saxfield Chatmon

*Attorney, Agent, or Firm*—Stanley Z. Cole; Richard B. Nelson

[57] ABSTRACT

In an electron beam tube such as a gyrotron, electron dissipation on the collector wall is often quite non-uniform due to radial concentrations of the electrons. The dissipation is made more uniform by pseudo-random scrambling of trajectories by transverse magnetic fields which are non-uniform in transverse and axial dimensions.

22 Claims, 8 Drawing Figures

ELECTRON BEAM SCRAMBLER

FIELD OF THE INVENTION

The invention pertains to high-power microwave tubes in which a beam of electrons, after passing through an interaction region in which some of their kinetic energy is converted into wave energy, enters a hollow collector and is caused to expand and be collected on the inner wall of the collector. The problem concerned is non-uniform heat dissipation over the collector surface. It is particularly severe in gyrotron tubes.

PRIOR ART

In tubes with a so-called linear beam of electrons, such as klystrons and traveling-wave tubes, the electron velocity is primarily parallel to the axis. The collector is a hollow bucket, closed at the downstream end. Inside the collector the axial magnetic field used to keep the beam focused in a uniform cylinder, is substantially removed and the beam expands under the mutual repulsion of its own space-charge force and strikes the collector wall. With some simplifying assumptions, it is possible to design the collector shape to have uniform power dissipating density for the most severe set of operating conditions. U.S. Pat. No. 2,928,972 issued May 15, 1960 to R. Nelson describes such a design.

In a gyrotron tube, such as described in U.S. Pat. No. 4,388,555, the interacting electromagnetic wave is usually in a mode with transverse, circular electric field. The wave-supporting cavity and output waveguide are figures of revolution about the axis to prevent excitation of spurious modes which do not have circular symmetry. In these gyrotrons the beam collector is also the output waveguide, with a circular ceramic vacuum window at its down-stream end. The electron beam is typically hollow, rotating about the axis as guided by an axial magnetic field. In the collector region this magnetic field is reduced toward zero and the beam expands, largely due to the centrifugal force of the rotating electrons. Ideally, there are no electrons at the beam center, so there is no bombardment of the window. In practice, however, electrons which have received centripetal velocity, and also randomly directed, high-speed secondaries, often strike the window. It has been known in the art to create a transverse magnetic field across the waveguide on the upstream side of the window to deflect these unwanted electrons away from the window. There is still a problem in that they are all deflected to the same side of the waveguide-collector and may cause non-uniform overheating on that side.

The electrons in the main stream are concentrated in certain ranges of radii, because the original beam is focussed at the radius or radii to interact where the circular electric field is most intense. The result of this is that certain axial zones of the collector surface receive extra high bombardment densities. To even out the dissipation by shaping the collector surface as described in above-mentioned U.S. Pat. No. 2,928,972 is not practical. Changes in the collector-waveguide diameter produce wave reflections. Also, if part of the collector is unduly enlarged, it can act as a resonant cavity supporting suprious wave modes.

SUMMARY OF THE INVENTION

An object of the invention is to provide an axial beam tube with improved uniformity of current interception on the surface of the collector.

This object is achieved by providing near the entrance to the collector a magnet to produce within the collector a component of magnetic field transverse to the beam axis. A pair of magnets may be used, positioned on opposite sides of the axis and magnetized in the same direction to produce a greater transverse field across the entire collector diameter. Also, a bifilar helix of opposed magnets may produce a transverse field rotating with axial distance.

DESCRIPTION OF THE PREFERRED EMBODIMENTS

Figure 1:
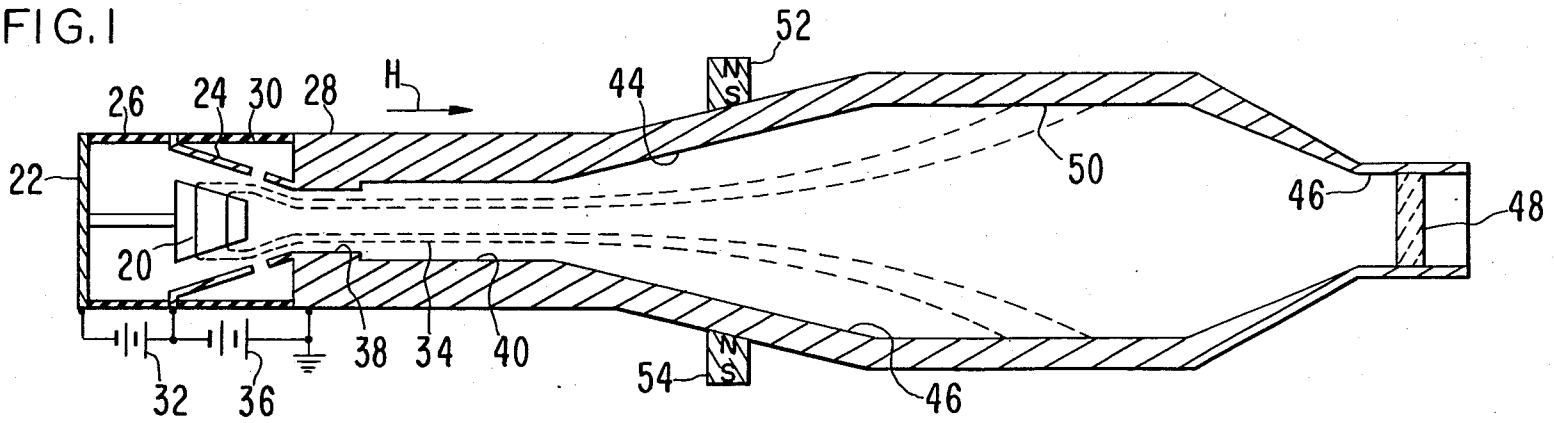
FIG. 1 is a schematic axial section of a gyrotron oscillator tube embodying the invention.

FIG. 1 illustrates a basic gyrotron oscillator. Such tubes have produced by far the highest power at the highest frequencies, and hence are peculiarly aided by embodying the invention. The gyrotron is a microwave tube in which a beam of electrons having spiral motions in an axial magnetic field parallel to their drift direction interact with the electric fields of a wave-supporting circuit. The electric field in practical tubes is in a circular-electric-field mode. In the gyrotron the wave-supporting circuit is a resonant cavity, usually resonating in a $TE_{0ml}$ mode.

In the gyro-monotron of FIG. 1 a thermionic cathode 20 is supported on the end plate 22 of the vacuum envelope. End plate 22 is sealed to the accelerating anode 24 by a dielectric envelope member 26. Anode 24 in turn is sealed to the main tube body 28 by a second dielectric member 30. In operation, cathode 20 is held at a potential negative to anode 24 by a power supply 32. Cathode 20 is heated by a radiant internal heater (not shown). Thermionic electrons are drawn from its conical outer emitting surface by the attractive field of the coaxial conical anode 24. The entire structure is immersed in an axial magnetic field H produced by a surrounding solenoid magnet (not shown). The initial radial motion of the electrons is converted by the crossed electric and magnetic fields to a motion away from cathode 20 and spiralling about magnetic field lines, forming a hollow beam 34. Anode 24 is held at a potential negative to tube body 28 by a second power supply 36, giving further axial acceleration to the beam 34. In the region between cathode 20 and body 28, the strength of magnetic field H is increased greatly, causing beam 34 to be compressed in diameter and also increasing its rotational energy at the expense of axial energy. The rotational energy is the part involved in the useful interaction with the circuit wave fields. The axial energy merely provides beam transport through the interacting region.

Beam 34 passes through a drift-tube or aperture 38 into the interaction cavity 40 which is usually resonant at the operating frequency in a $TE_{oml}$ mode. The magnetic field strength H is adjusted so that the cyclotron frequency rotary motion of the electrons is approximately synchronous with the cavity resonance. The electrons can then deliver rotational energy to the circular electric field, setting up a sustained oscillation.

At the output end of cavity 40, an outwardly tapered section 44 couples the output energy into a uniform waveguide 46 which has a greater diameter than resonant cavity 40 in order to propagate a traveling wave. Near the output of cavity 40 the magnetic field H is reduced. Beam 34 thus expands in diameter under the influence of the expanding magnetic field lines and its own self-repulsive space charge. Beam 34 is then collected on the inner wall of waveguide 46, which also serves as a beam collector. A dielectric window 48, as of alumina ceramic, is sealed across waveguide 46 to complete the vacuum envelope. The collector portion 50 of waveguide 46 is larger than needed to carry the wave, in order to increase the energy dissipating area. Guide 46 is tapered down past the intercepting area 50 to output window 48.

According to the invention, a magnet 52 (preferably a permanent magnet) is supported just outside collector 46 and magnetized perpendicular to the axis to create a magnetic field component perpendicular to the axis. A second, similar magnet 54 may be placed opposite magent 52 and magnetized in the same direction. The pair produces a much greater field strength over the cross section of the collector.

Figure 2:
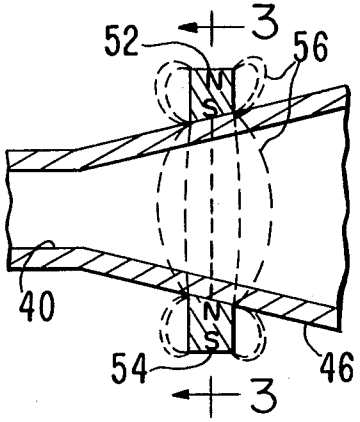
FIG. 2 is a portion of FIG. 1 with added sketched flux lines.

FIG. 2 illustrates the lines of magnetic flux in the axial plane. The flux lines 56 are much closer to each other near the plane of the magnets, so the transverse field component is quite non-uniform in this plane.

Figure 3:
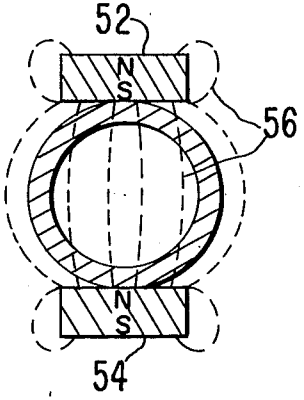
FIG. 3 is a section perpendicular to the axis of the tube of FIG. 1.

FIG. 3 is a section perpendicular to the axis of the portion shown in FIG. 2. The magnets 52, 54 are extended in width to produce a stronger field which is somewhat less non-uniform over the plane perpendicular to the axis.

Figure 4:
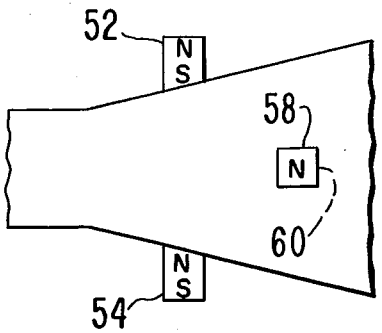
FIG. 4 is a view perpendicular to the axis of a different embodiment.

FIG. 4 is another embodiment in which two opposed magnet pairs as in FIGS. 2 and 3 are spaced axially so as not to form a quadrupole, but to interact successively with the electron beam. The two pairs are displaced azimuthally about the axis by 90 degrees to interact strongly with different azimuthal portions of the beam. Obviously, more magnets or pairs can be added. Magnets 52 and 54 are the first pair and magnets 58 and 60 are a second pair spaced axially along collector 46.

Figure 5:
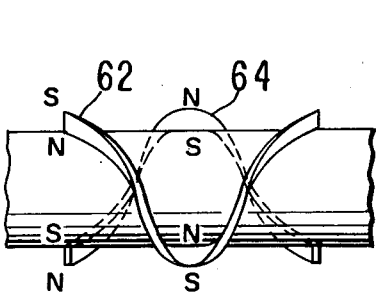
FIG. 5 is a view perpendicular to the axis of a still different embodiment.

FIG. 5 shows another embodiment in which the magnets are extended as two members 62, 64 of a bifilar helix. The extended members 62, 64 may be composed as rows of separate magnets supported by a non-magnetic support member, each being magnetized in a direction pointing toward the axis. Another embodiment is to use a strip of flexible plastic material loaded with magnetic particles. The particles are all magnetized in a direction perpendicular to one surface of the strip. Two strips are then wound on to the collector's outer surface in the pattern of a bifilar helix. Opposed portions of the two strips are magnetized in the same direction to produce a transverse field component over the entire collector cross-section. This field component rotates with axial distance so that all portions of the beam receive a similar exposure to transverse field. The axial position of this exposure varies with the azimuthal position of the portion of the beam.

The action of the inventive non-uniform transverse field components is quite complicated. Accurate analysis and analytical design are not now practical. The general principle is that transverse magnetic field components are established which are variable in direction and/or strength over the crosssection and/or axial length of the beam deflect beam electrons in a somewhat random manner depending on each electron's position in the beam, and initial velocity, both of which are changing with time and the phase of the rf cyclic. A generally random deflection is believed to be optimum for spreading out the axial zones of intense collector bombardment as well as the radial zones caused by accidental lack of circular symmetry.

The scrambling magnets are placed near the collector entrance so their effect will be felt over much of its length. They are, however, axially downstream from the entrance far enough for the axial leakage field of the interaction focussing magnet to have decayed to a small fraction of its maximum value.

We have carried out calculations for a simplified special example.

Figure 6:
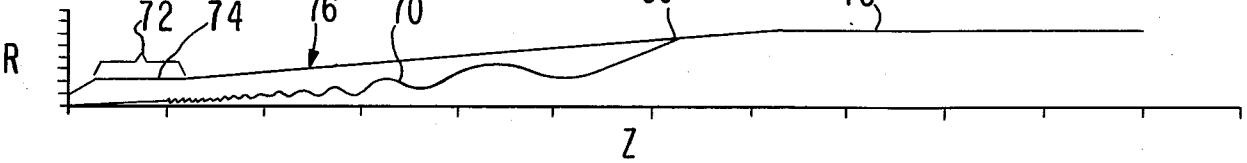
FIG. 6 is a graph of radial trajectories of electrons in a gyrotron collector without the invention.

FIG. 6 is a calculated graph of the radial component of electron trajectories in a collector in which the fields have perfect circular symmetry. The radial component is independent of the azimuthal position of the entering electron. The trajectory 70 oscillates at a slowly building-up amplitude in the cylindrical interaction cavity 74. The output waveguide 76 tapers gradually to a diameter larger than cavity 74 to support a traveling output wave. In this region the strong (many kilogauss) axial interaction field in cavity 74 decays. The electrons entering at the selected entrance radius have their cyclotron orbit radius expanding inversely with the axial field. Waveguide 76 continues to expand to the radius of the full collector 78. All the electrons of the selected radius strike the wall in a ring at the same axial position 80. Since the electrons in the hollow beam passing through the interaction cavity 74 have only a narrow range of initial radii, the collector dissipation is very high near interception ring 80 and relatively low elsewhere. For the power levels at which gyrotrons excel, collector failure by high dissipation is a serious problem.

Figure 7A:
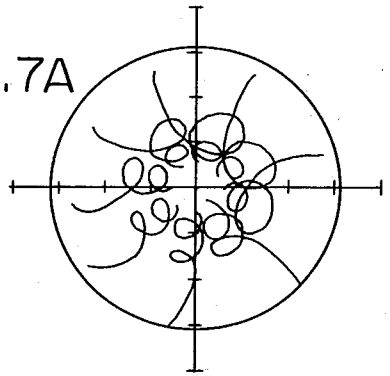
FIGS. 7A and 7B are graphs of radial trajectories in the collector of FIG. 5, but in addition embodying the invention.
Figure 7B:
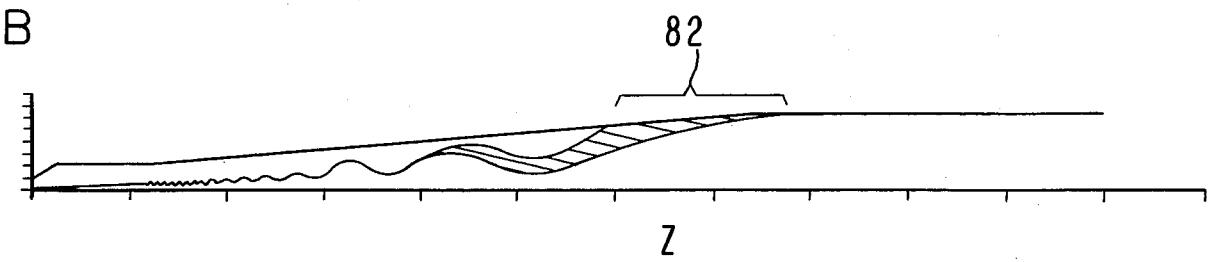

FIGS. 7A and 7B are calculated graphs of electron trajectories in the same gyrotron as in FIG. 6 but with the addition of a helical transverse field component as generated by the inventive scrambling magnet of FIG. 5. Paths of 8 electrons are plotted, all starting at the same radius as in FIG. 6 and at azimuthal positions displaced from each other by 45°. Since each electron enters the transverse field at a different axial distance, the paths from that point on will be different. FIG. 7A is a plot of motion projected on a plane perpendicular to the axis. FIG. 7B is a plot of radial motion. The important feature is that the axial positions of interception are spread out over a considerable distance 82, depending on the initial azimuthal position, instead of being concentrated at one ring 80 as in FIG. 6.

It will be obvious to those skilled in the art that many other embodiments may be made within the scope of the invention. For example, it might well be that a truly randomly-placed set of transverse scrambling magnets or opposed pairs downstream of the interaction means adjacent the collector would work satisfactorily.

The above examples are exemplary and not limiting. The invention is to be limited only by the following claims and their legal equivalents.

What is claimed is:

1. A tube adapted to propagate a beam of electrons having a component of motion in an axial direction, comprising:

a vacuum envelope;

cathode means for generating said beam;

interaction means for causing said beam to generate an electromagnetic wave;

output window means for extracting said wave;

collector means downstream of said interaction means at least partially surrounding said beam and adapted to intercept said beam; and means for dispersing said beam to increase the spatial uniformity of current interception on the inner surface of said collector means; said dispersing means comprising, a first and a second magnet, each disposed to produce within said collector a component of magnetic field crossing said axis and non-uniform on a circle perpendicular to said axis;

said second magnet being displaced from said first magnet azimuthally about said axis and axially by an amount comparable to the radius of said collector.

2. The tube of claim 1 wherein said tube is a gyrotron.

3. The tube of claim 1 wherein said magnet is a permanent magnet.

4. The tube of claim 1 further comprising a third magnet generally opposite said first magnet with respect to said axis and magnetized in the same general direction as said first magnet.

5. The tube of claim 4 further comprising a fourth magnet opposite said second magnet forming a second pair of opposed magnets, each of said second pair being magnetized in the same direction.

6. The tube of claim 5 further comprising other pairs of magnets arrayed on the path of a bifilar helix, the magnets on one strand of said helix being magnetized generally toward said axis and the magnets on the other strand being magnetized generally away from said axis.

7. The tube of claim 4 wherein said first and second magnets are continuous strips conformed to the outer surface of said collector, said first strip being magnetized toward said axis and said second strip being magnetized away from said axis.

8. The tube of claim 7 wherein said strips form the strands of a bifilar helix.

9. The tube of claim 7 wherein said strips are flexible bands of material loaded with magnetic particles.

10. The tube of claim 1 further comprising means for applying an axial magnetic field in said interaction means to guide said electrons, and wherein said magnet is at an axial position near the entrance to said collector but where said axial magnetic field has declined to a small fraction of its maximum value in said interaction means.

11. The tube of claim 10 where said fraction is less than 1/10.

12. In a gyrotron type microwave tube:

means for generating a beam of electrons having a component of velocity along a longitudinal axis;

interaction cavity means for causing said beam to generate an electromagnetic wave;

collector means for said beam downstream of said cavity means for intercepting the electrons of said beam;

window means at the downstream end of said collector means for extracting said wave; and a first and second means for producing at said collector a nonuniform magnetic field transverse to said axis, varying in direction and/or strength, said second means being displaced from said first means axially and azimuthally about said axis.

13. A tube as in claim 12 in which said magnetic field includes a nonuniform component in a plane parallel to said axis.

14. A tube as in claim 12 in which said magnetic field includes a nonuniform component in a plane perpendicular to said axis.

15. A tube as in claim 12 in which said magnetic field includes a component which is nonuniform on a circle coaxial with said axis.

16. A tube as in claim 12 in which each of said means for producing said nonuniform magnetic field includes a first permanent magnet means attached to said collector and magnetized in a direction generally perpendicular to said axis.

17. A tube as in claim 16 in which said first permanent magnet means extends generally transversely to said axis.

18. A tube as in claim 17 in which said permanent magnet means extends transversely a distance of the order of the diameter of said beam.

19. A tube as in claim 16 in which said means for producing said nonuniform magnetic field includes a second permanent magnet means positioned opposite said first magnet means with respect to said axis.

20. A tube as in claim 12 in which said means for producing said nonuniform magnetic field includes a plurality of permanent magnet pairs, with one magnet of each pair being positioned oppositely to the other magnet of said pair with respect to said axis, and with the plurality of magnet pairs arrayed so as to define a bifilar helix.

21. A tube as in claim 12 adapted for use with means producing an axial field along said axis acting on said interaction means, wherein the electrons of said beams undergo spiral motions in said interaction means.

22. A tube as in claim 21 in which said means for producing said nonuniform transverse magnetic field applied said transverse field at portions of the collector where said axial magnetic field has decayed to a small fraction of its maximum value.

* * * * *